US005509225A

United States Patent [19]

Minh et al.

[11] Patent Number: 5,509,225

[45] Date of Patent: Apr. 23, 1996

[54] REPLACEABLE SIGN PANEL ASSEMBLY FOR A MERCHANDISE CABINET

[75] Inventors: Tran Q. Minh, Stockbridge; Edwin F. Womack, Jr., Marietta; Leonard F. Antao, Lawrenceville, all of Ga.

[73] Assignee: The Coco-Cola Company, Atlanta, Ga.

[21] Appl. No.: 281,647

[22] Filed: Jul. 29, 1994

[51] Int. Cl.[6] ..... G09F 7/02

[52] U.S. Cl. ..... 40/611; 40/575

[58] Field of Search ..... 40/611, 594, 575, 40/564, 618

[56] References Cited

U.S. PATENT DOCUMENTS

| | | | |
|---|---|---|---|
| 2,624,141 | 1/1953 | Martin | 40/618 X |
| 3,703,779 | 11/1972 | Goldman | 40/564 X |
| 4,070,779 | 1/1978 | Gilmour | 40/575 |
| 4,320,933 | 3/1982 | Felix et al. | 312/291 |
| 4,380,130 | 4/1983 | Bachmann et al. | 40/584 |
| 4,536,423 | 8/1985 | Travis | 40/594 X |
| 4,557,517 | 12/1985 | Boldue et al. | 40/590 X |
| 4,653,209 | 3/1987 | Cobb | 40/618 |
| 4,682,709 | 7/1987 | Brandes et al. | 40/541 |
| 5,255,968 | 10/1993 | Craven | 312/234 |

*Primary Examiner*—Peter M. Cuomo
*Assistant Examiner*—James O. Hansen
*Attorney, Agent, or Firm*—Birch, Stewart, Kolasch & Birch

[57] ABSTRACT

A sign panel assembly for use in conjunction with an illuminated sign panel on a merchandise cabinet, such as a vending machine or refrigerated display case includes two elongated transparent framing strips, pieces of double-face tape on the distal ends of each strip, and a flexible sign panel with graphics or artwork therein insertable between the strips and a back surface of the illuminated sign. The sign panels may be easily interchanged in order to display different graphics or artwork as desired.

29 Claims, 3 Drawing Sheets

REPLACEABLE SIGN PANEL ASSEMBLY FOR A MERCHANDISE CABINET

BACKGROUND OF THE INVENTION

The present invention relates to a replaceable sign panel assembly for use on a product merchandise cabinet, such as a vending machine or refrigerated display cabinet. More specifically, the present invention relates to a replaceable sign panel assembly which may be quickly and easily installed in a window area of a back-lighted sign panel on the front door of a vending machine or display cabinet for food or beverage products.

In the design of vending machines and refrigerated display cabinets a great deal of effort goes into the design of the front face of the device in order to attract customers to purchase selected goods therefrom. Typical vending machines include an illuminated sign on the front face of the machine formed of a polymeric material having transparent, translucent and colored areas in order to display graphics relating to product identifying trademarks advertisements or the like. These illuminated signs are usually back-lighted with fluorescent tubes disposed within the cabinet and the front face of the machine is often curved or bowed in order to provide even illumination and better visibility of the sign from a wider range of angles.

These sign panels on the front face of machines are quite expensive since the polymeric material must be made tough enough to withstand vandalism or attempts at forced entry into the machines. Furthermore the graphics and product identifying logo thereon which are generally applied by silkscreening adds to the expense of the sign panel.

It is highly desirable to be able to periodically change the graphics on the sign panels to include advertisements or the like. This can be done by changing the entire sign panel but such a solution is quite expensive.

Attempts have been made to provide interchangeable sign panels which snap into the door which supports the front sign panel. Assemblies of this type, however, require disassembly of components of the vending machine such as support plates for the door and the fluorescent tubes which back-light the sign panel.

Accordingly, a need in the art exists for a replaceable sign panel assembly which may be readily and easily installed to the back wall of an illuminated sign panel of a vending machine or display cabinet without disassembling any of the machine components.

SUMMARY OF THE INVENTION

Accordingly, it is a primary object of the present invention to provide a replaceable sign panel assembly for installation within an illuminated sign panel of a vending machine or display cabinet which may be quickly and readily installed without modification or disassembly of any of the machine components.

It is another object of the present invention to provide a method for installing a replaceable sign panel assembly for a vending machine or display cabinet.

It is still another object of the present invention to provide a replaceable sign panel assembly for a vending machine or display cabinet which may be installed on the backside of an illuminated sign panel within a designated window area defined by surrounding product identifying logo so that the graphics on the replaceable sign panel assembly blend with the surrounding product identifying graphics in an aesthetically pleasing way.

The objects of the present invention are fulfilled by providing a sign panel assembly for use on a selected area of an illuminated sign which forms a front face of a vending machine or display cabinet comprising:

at least two elongated framing strips formed of transparent plastic material;

fastening means for connecting said strips to said illuminated sign; and a flexible sign panel having a central field for containing graphic material therein and spaced side portions to be supported by said framing strips against a rear surface of said illuminated sign.

The fastening means preferably comprises pieces of double-face tape secured to the respective distal ends of the framing strips. The pieces of double-face tape are spaced at a distance slightly greater than the height of the sign panel so that the sign panel may fit within and be supported by the edges of the tape.

An additional piece, or pieces, of double-face tape may be provided for securing the central field of the sign panel to the rear surface of the illuminated sign of the vending machine to ensure that the sign panel is evenly secured across its surface to the rear of the illuminated sign.

The flexible sign panel may include any form of advertisements, messages or interesting artwork in various colors which would in conjunction with the surrounding product identifying logo attract users to the vending machine or display cabinet in order to induce the sale of products from the machine. The graphics on the sign panel are preferably applied by silkscreening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects of the present invention and the attendant advantages thereof will become more readily apparent by reference to the drawings wherein like reference numerals refer to like parts and wherein.

DESCRIPTION OF PREFERRED EMBODIMENTS

Figure 1:
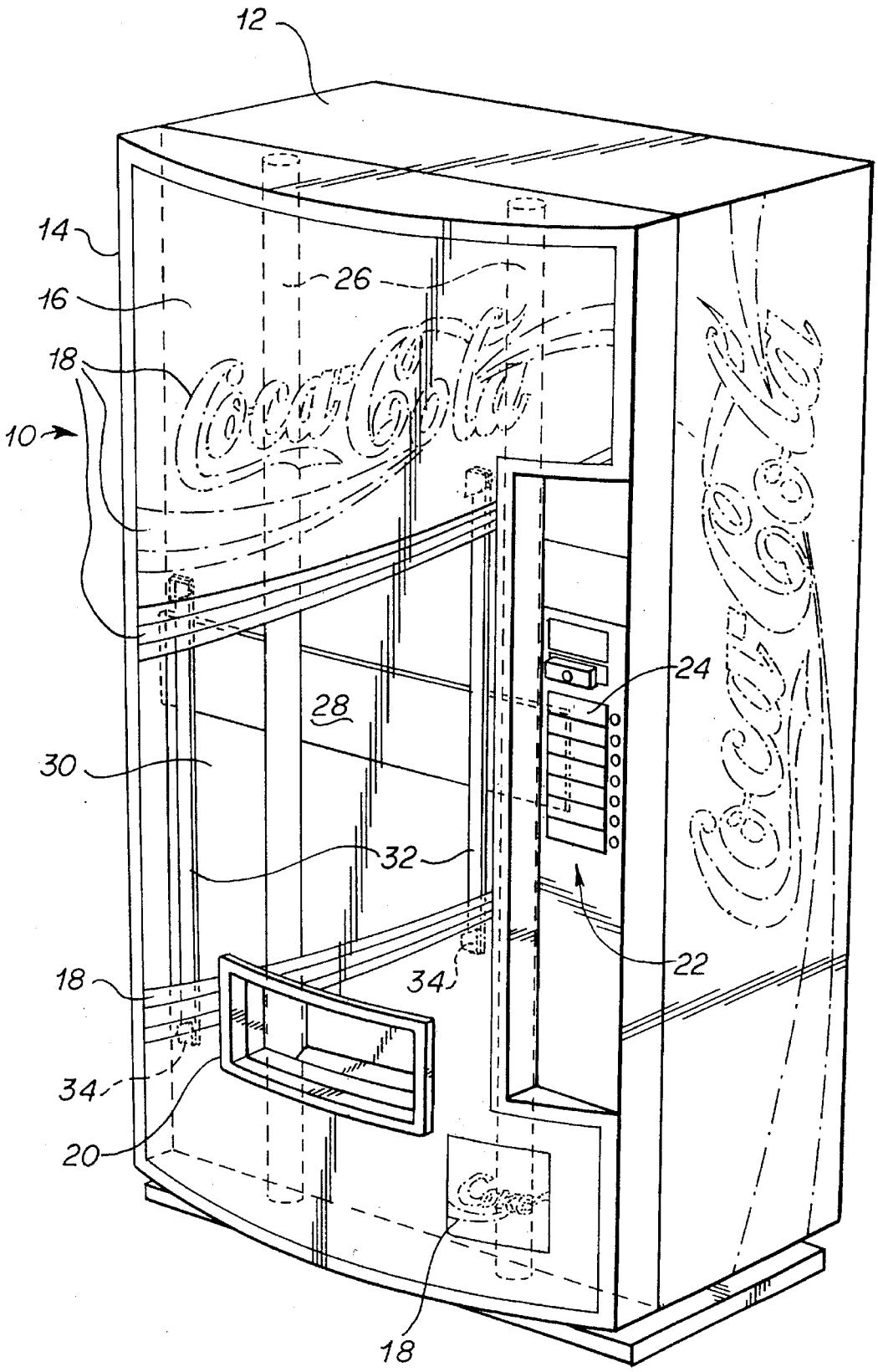
FIG. 1 is a perspective view illustrating a product vending machine with a portion of the sign panel assembly of the present invention installed therein behind a designated window area in the illuminated sign panel on the front face of the machine.

Referring to FIG. 1 there is illustrated a vending machine 10 including a cabinet 12 with rectangular top, bottom, side and rear walls. A door 14 is hinged to cabinet 12 at the left side thereof and forms the front wall of the vending machine including an illuminated sign 16 with product identifying logo 18 thereon surrounding a designated window area in which a sign panel 30 of the assembly of the present invention is attached to the rear wall thereof. A discharge port 20 is provided through the face of the sign 16 for delivering the vendable products. A control panel 22 is provided in front door 14 within a cut-out section in the sign 16. The control panel includes a plurality of product selection buttons 24 and other conventional components such as a coin slot, a currency validator and any other components desirable for controlling the operation of the vending machine. The sign 16 is back-lighted by a pair of fluorescent light sources 26 to enhance the visibility of the product identifying logo or graphics 18 on the front of the machine.

Figure 2:
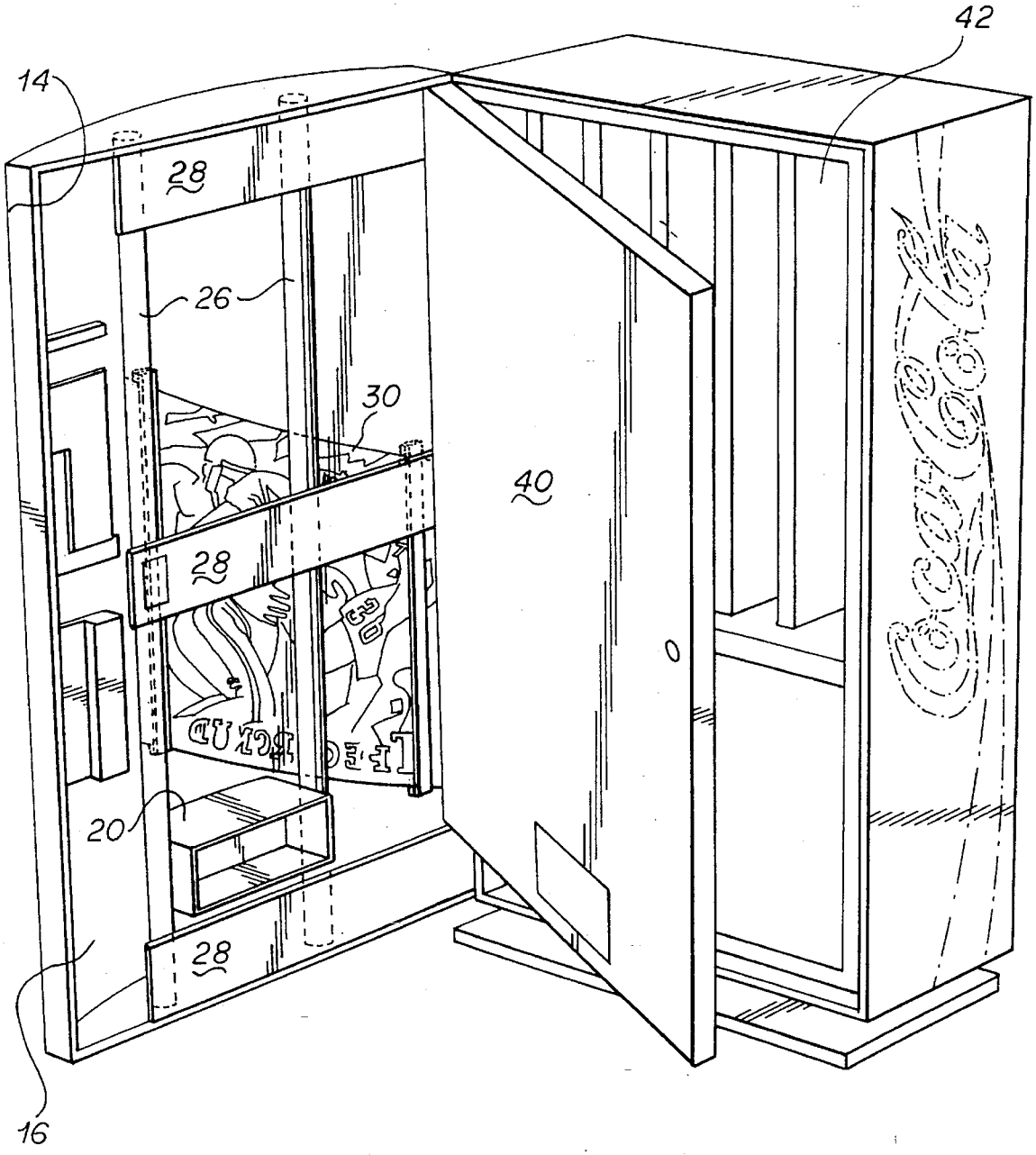
FIG. 2 is a perspective view of the vending machine of FIG. 1 with the front door open, and viewed from the rear thereof, to illustrate the location of installation of the sign panel assembly of the present invention therein.

As illustrated in FIG. 2 an inner door 40 is provided behind the front door 14 for enclosing the compartment within the cabinet containing a plurality of product columns 42.

Also illustrated in FIG. 2 is a view of the rear side of door 14 and illuminated sign 16 therein. The sign panel assembly of the present invention is illustrated therein as secured to the rear surface of sign 16. The sign panel assembly includes a pair of vertically mounted elongated plastic framing strips 32 having pieces of double-face tape 34 secured at the distal ends thereof. The double-face tape 34 is utilized to secure the strips 32 to the rear of sign 16 in the spaced configuration illustrated so that sign panel 30 may be slipped into slots formed between strips 32 and the rear surface of sign 16. Other types of adhesive materials may be used instead of doubleface tape without departing from the spirit and scope of the present invention.

Figure 3:
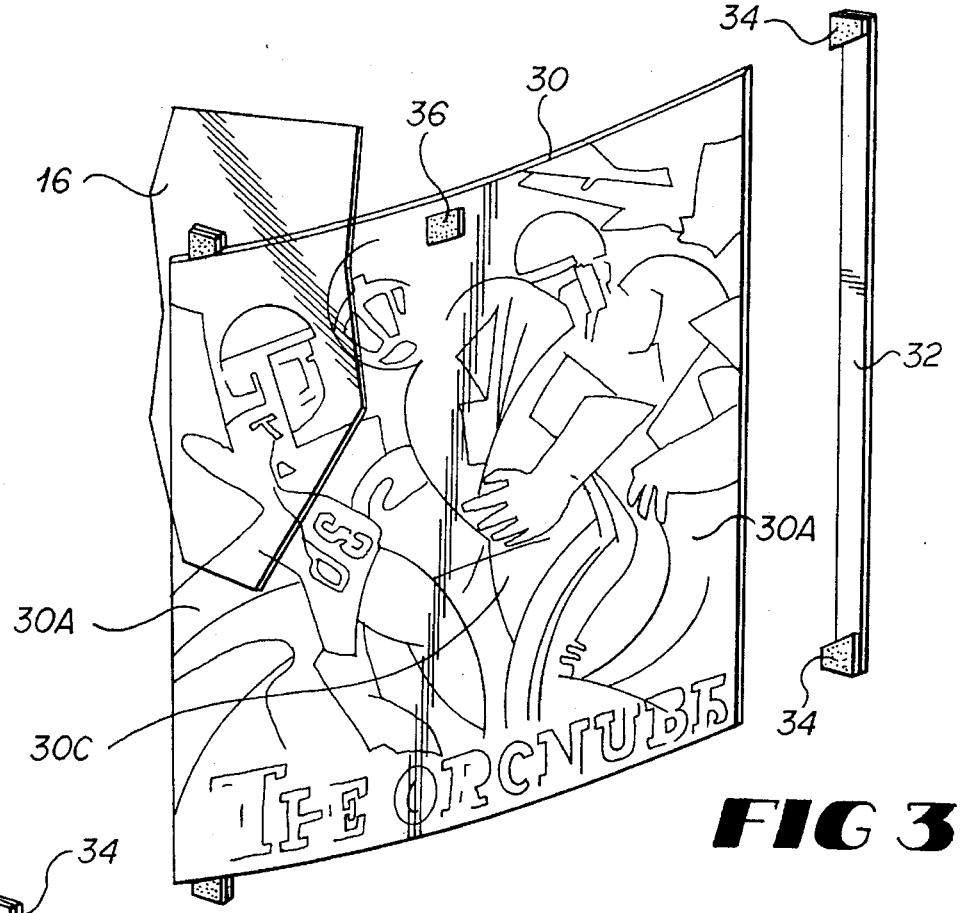
FIG. 3 is a fragmentary view of a portion of the illuminated sign of the vending machine of FIG. 1 illustrating in more detail how the sign panel assembly of the present invention is attached to the rear surface thereof.
Figure 4:
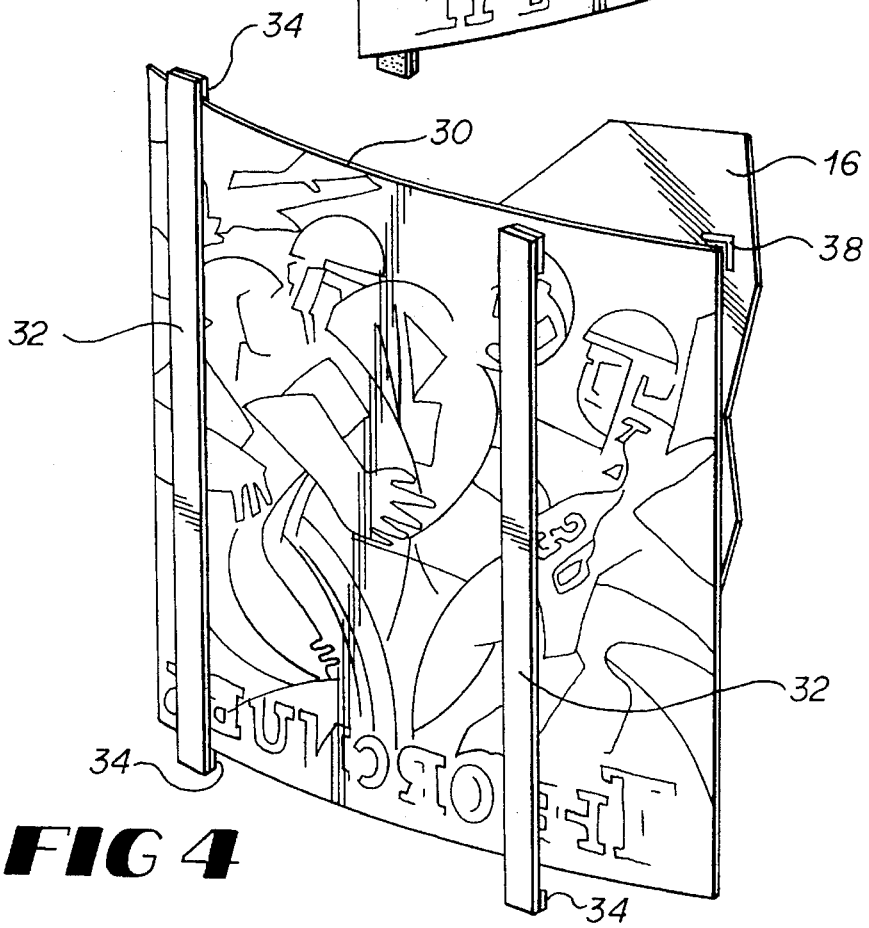
FIG. 4 is a fragmentary view of a portion of the illuminated sign of the vending machine of FIG. 1 viewed from the rear side thereof to further illustrate how the sign panel assembly of the present invention is secured thereto.

The sign panel assembly and the method for assembling the same on the rear surface of sign 16 can be more readily understood by reference to FIGS. 3 and 4. In FIG. 3 there is illustrated a portion of sign 16 to which the sign panel 30 of the assembly of the present invention is secured by the respective strips 32 having double-face tape pieces 34 thereon.

The sign panel 30 is preferably formed of a very thin plastic material of for example 0.025" in thickness. Therefore, sign panel 30 is very flexible and can even be rolled up for storage purposes before attaching the sign panel within the vending machine. Sign panel 30 has two side portions 30A and a center field portion 30C in which suitable graphics, advertisements or other artwork is disposed. In the example illustrated in FIG. 3 the artwork relates to a seasonal promotion of football, in this case a congratulatory message for the victory of a local team.

The panel 30 is preferably fabricated from polystyrene but other plastic materials, paper, or plastic-coated paper may be used. Preferably the material selected is capable of receiving the desired graphics in color from a computer printer. This has cost advantages as compared to silkscreening techniques. Furthermore, electronically stored graphics and artwork can be transferred by telephone electronically to various service areas from a central location. This provides the capability of almost instantly transmitting new signs and graphics to multiple locations in order to quickly implement a new promotion campaign or message. For example, in the example shown the congratulatory message for a football victory could be transmitted, printed and installed overnight.

As further illustrated in FIG. 3 an additional piece of double-face tape 36 may be provided for securing the central field 30C to the rear of sign panel 16 in a manner to be more fully described hereinafter.

FIG. 4 is a similar illustration to that of FIG. 3 from the opposite or rear side of sign 16. As illustrated in FIG. 4 indexing corner marks 38 may be provided on the rear of sign 16 for each of the distal ends of strips 32 in order to ensure that a serviceman changing the sign panel 30 installs the strips 32 and associated adhesive on double-face tape pieces 34 in the proper location, so that sign panel 30 will be in registry with the window defined by the surrounding graphics within sign 16. As illustrated in FIG. 2 this window is defined between the "wave" portions of graphics 18 which define a window generally in the shape of a parallelogram.

Accordingly, the general shape of sign panel 30 as illustrated in FIGS. 3 and 4, is also a parallelogram. Double-face tape pieces 34 are cut at an angle of approximately 60° with respect to the longitudinal axis of the strips for supporting the top and bottom edges of the parallelogram-shaped sign panel 30 therebetween.

The regions of the sign 16 overlying the location of the edges of the sign may have graduated (gray scale) shading from light to darkest near the edges so that the edges are not visible through the front of sign 16. Thus, when viewing the front of sign 16 the graphics thereon in combination with the graphics within sign panel 30 will have a smooth continuous appearance. This results in an aesthetically appealing display.

In addition to graduated shading on sign 16 the inner edges of strips 32 may be beveled on the backsides to minimize the scattering of light. Any beveled angle may be chosen but 45° is preferred.

The sign panel assembly of the present invention may be easily installed through the back of door 14 of the vending machine without disturbing or removing fluorescent light tubes 26 and braces 28 bridging the door frame. The sign panel 30 is very flexible so it may be rolled up and fed between the tubes 26 and braces 28 with little or no trouble.

Preferably the sign panel assembly is installed to the back side of the curved sign 16 of the vending machine by first installing framing strips 32 in vertical spaced relationship such as illustrated in FIG. 2. Since framing strips 32 have adhesive surfaces thereon in the regions of double-face tape pieces 34, these strips may be simply stuck to the back of the sign 16 as illustrated. As stated hereinbefore, indexing corner marks 38 may be provided for each end of the framing strips 32 to ensure proper location thereof.

The sign panel 30 may then be installed by inserting one end thereof and its associated side portion 30A between a strip 32 and the back wall surface of sign panel 16. The sign panel 30 may then be pressed against the rear of sign 16 and the opposite end, or side portion 30A, is inserted between the other of the frame strips 32 and the back wall surface of sign 16. The width of the sign panel 30 is preferably selected so that the ends thereof are flush with the outside edges of strips 32 when installation is complete. Double face tape piece 36 may either already be present on the sign panel 30, or may be added thereto in order to better secure the center portion of the sign panel 30 to the rear of sign 16.

Sign panel 30 may initially be rolled up, and then unrolled following insertion of a first end thereof extending from the roll into the space between one of the strips 32 and the rear surface of sign 16.

Accordingly, it can be seen that the sign panel assembly of the present invention may be quickly and readily installed and changed without disturbing any of the other components of the vending machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sign panel assembly for use on a selected area of an illuminated sign on a merchandise cabinet comprising:

at least two elongated framing strips formed of transparent plastic material;

fastening means for connecting said strips to said illuminated sign, said fastening means including spaced adhesive regions on distal ends of each framing strip, the space between each adhesive region being at least as great as the height of said flexible sign panel; and a flexible sign panel having a central field for containing graphic material therein and spaced side portions to be supported by said strips against a rear surface of said illuminated sign.

2. The sign panel assembly of claim 1 wherein said adhesive regions include pieces of double-face tape, one adhesive face of each piece of tape being adhesively secured to an associated strip and the other face of the piece of tape being exposed and attachable to the illuminated sign.

3. The sign panel assembly of claim 2 further including an additional fastening means for securing the central field of the flexible sign panel to the rear surface of said illuminated sign.

4. The sign panel assembly of claim 3 wherein said additional fastening means includes a piece of doubleface tape, one adhesive face of the tape being securable to said central portion of the flexible sign panel and the other face being exposed and attachable to the rear face of the illuminated sign.

5. The sign panel assembly of claim 1 further including an additional fastening means for securing the central field of the flexible sign panel to the rear surface of said illuminated sign.

6. The sign panel assembly of claim 5 wherein said additional fastening means includes a piece of doubleface tape, one adhesive face of the tape being securable to said central portion of the flexible sign panel and the other face being exposed and attachable to the rear face of the illuminated sign.

7. The sign panel assembly of claim 1 wherein said framing strips have inner and outer longitudinal edges and at least the inner edges are beveled to minimize light scattering therefrom.

8. In a vending machine having an outer door and an illuminated sign in said outer door, the improvement comprising:

a sign panel assembly for use on a selected area of the illuminated sign in the door including, at least two elongated framing strips formed of transparent plastic material, said fastening means including spaced adhesive regions on distal ends of each framing strip, the space between each adhesive region being at least as great as the height of said flexible sign panel, fastening means for connecting said strips to said illuminated sign, and a flexible sign panel having a central field for containing graphic material therein and spaced side portions to be supported by said strips against a rear surface of said illuminated sign.

9. The vending machine of claim 8 wherein said adhesive regions include pieces of double-face tape, one adhesive face of each piece of tape being adhesively secured to an associated strip and the other face of the piece of tape being exposed and attachable to the illuminated sign.

10. The vending machine of claim 9 further including an additional fastening means for securing the central field of the flexible sign panel to the rear surface of said illuminated sign.

11. The vending machine of claim 10 wherein said additional fastening means includes a piece of double-face tape, one adhesive face of the tape being securable to said central portion of the flexible sign panel and the other face being exposed and attachable to the rear face of the illuminated sign.

12. The vending machine of claim 8 further including an additional fastening means for securing the central field of the flexible sign panel to the rear surface of said illuminated sign.

13. The vending machine of claim 12 wherein said additional fastening means includes a piece of double-face tape, one adhesive face of the tape being securable to said central portion of the flexible sign panel and the other face being exposed and attachable to the rear face of the illuminated sign.

14. The vending machine of claim 8 wherein said illuminated sign is back-lighted from illumination means disposed within the vending machine behind a rear wall of the sign.

15. The vending machine of claim 8 wherein said illuminated sign has curved front and rear surfaces providing a bowed front to the vending machine.

16. The vending machine of claim 8 wherein said illuminated sign includes a translucent front panel, said front panel having gray scale shaded areas in optical alignment with said framing strips in order to obscure the visibility of the strips from a front face of the front panel.

17. The vending machine of claim 8 further comprising indexing marks on a rear surface of the illuminated sign for indicating a preferred location for securing said framing strips.

18. The vending machine of claim 8 wherein said framing strips have inner and outer longitudinal edges and at least the inner edges are beveled to minimize light scattering therefrom.

19. A method of securing a sign panel assembly to a selected area on a rear surface of an illuminated sign on a cabinet comprising the steps of:

a) providing a sign panel assembly including, at least two elongated framing strips formed of transparent plastic material, fastening means for connecting said strips to said illuminated sign, said fastening means including spaced adhesive regions on distal ends of each framing strip, the space between each adhesive region being at least as great as the height of said flexible sign panel and a flexible sign panel having a central field for containing graphic material therein and spaced side portions to be supported by said strips against a rear surface of said illuminated sign;

b) securing said strips to a rear surface of the illuminated sign in spaced relationship utilizing the fastening means; and c) inserting the side portions of the flexible sign panel between the strips and the rear surface of the illuminated sign.

20. The method of claim 19 wherein said adhesive regions include pieces of double-face tape, one adhesive face of each piece of tape being adhesively secured to an associated strip and the other face of the piece of tape being exposed and attachable to the illuminated sign.

21. The method of claim 20 further including an additional fastening means for securing the central field of the flexible sign panel to the rear surface of said illuminated sign and the additional step of securing the flexible sign panel to the illuminated sign therewith.

22. The method of claim 21 wherein said additional fastening means includes a piece of double-face tape, one adhesive face of the tape being securable to said central portion of the flexible sign panel and the other face being exposed and attachable to the rear face of the illuminated sign.

23. The method of claim 19 further including an additional fastening means for securing the central field of the flexible sign panel to the rear surface of said illuminated sign and the additional step of securing the flexible sign panel to the illuminated sign therewith.

24. The method of claim 23 wherein said additional fastening means includes a piece of double-face tape, one adhesive face of the tape being securable to said central portion of the flexible sign panel and the other face being exposed and attachable to the rear face of the illuminated sign.

25. The method of claim 19 wherein the inserting step c) is performed by inserting one of the side portions of the flexible sign panel, extending from a rolled-up configuration thereof, into one of said framing strips; unrolling the flexible sign panel against the rear surface of the illuminated sign; and inserting the other side portion into the other one of the framing strips.

26. The method of claim 19 wherein said framing strips have inner and outer longitudinal edges and at least the inner edges are beveled to minimize light scattering therefrom.

27. A sign panel assembly for use on a selected area of an illuminated sign on a merchandise cabinet comprising:

at least two elongated framing strips formed of transparent plastic material, said framing strips having inner and outer longitudinal edges, at least the inner edges being beveled to minimize light scattering therefrom;

fastening means for connecting said strips to said illuminated sign; and a flexible sign panel having a central field for containing graphic material therein and spaced side portions to be supported by said strips against a rear surface of said illuminated sign.

28. In a vending machine having an outer door and an illuminated sign in said outer door, the improvement comprising:

a sign panel assembly for use on a selected area of the illuminated sign in the door including, at least two elongated framing strips formed of transparent plastic material, said framing strips having inner and outer longitudinal edges, at least the inner edges being beveled to minimize light scattering therefrom, fastening means for connecting said strips to said illuminated sign, and a flexible sign panel having a central field for containing graphic material therein and spaced side portions to be supported by said strips against a rear surface of said illuminated sign.

29. A method of securing a sign panel assembly to a selected area on a rear surface of an illuminated sign on a cabinet comprising the steps of:

a) providing a sign panel assembly including, at least two elongated framing strips formed of transparent plastic material;

fastening means for connecting said strips to said illuminated sign, said framing strips having inner and outer longitudinal edges, at least the inner edges beveled to minimize light scattering therefrom, and a flexible sign panel having a central field for containing graphic material therein and spaced side portions to be supported by said strips against a rear surface of said illuminated sign;

b) securing said strips to a rear surface of the illuminated sign in spaced relationship utilizing the fastening means; and c) inserting the side portions of the flexible sign panel between the strips and the rear surface of the illuminated sign.

* * * * *